United States Patent [19]

Ziemba

[11] 4,147,109

[45] Apr. 3, 1979

[54] CONTROLLED RANGE FUZE

[75] Inventor: Richard T. Ziemba, Burlington, Vt.

[73] Assignee: General Electric Company, Burlington, Vt.

[21] Appl. No.: 769,756

[22] Filed: Feb. 17, 1977

[51] Int. Cl.[2] ..... F42C 17/00

[52] U.S. Cl. ..... 102/215

[58] Field of Search ..... 102/70.2 R, 70.2 P

[56] References Cited

U.S. PATENT DOCUMENTS

| | | | |
|---|---|---|---|
| 2,644,398 | 7/1953 | Rabinow | 102/70.2 R |
| 3,500,746 | 3/1970 | Ambrosini | 102/70.2 R |
| 3,646,371 | 2/1972 | Flad | 102/70.2 R |
| 3,670,652 | 6/1972 | Ziemba | 102/70.2 P |
| 3,748,955 | 7/1973 | Gatermann et al. | 102/70.2 R |
| 3,750,583 | 8/1973 | White et al. | 102/70.2 R |
| 3,793,957 | 2/1974 | Stout et al. | 102/70.2 R |
| 3,844,217 | 10/1974 | Ziemba | 102/70.2 R |

*Primary Examiner*—Charles T. Jordan
*Attorney, Agent, or Firm*—Bailin L. Kuch

[57] ABSTRACT

The object of this invention is to provide an additional order of decimal magnitude to a single, continuous tape type decimal to binary converter for a counter in a controlled range fuze, utilizing the setting ring for the tape to set in the additional order as a vernier to the tape supplied orders.

8 Claims, 3 Drawing Figures

CONTROLLED RANGE FUZE

BACKGROUND OF THE INVENTION

1. Field of Art

This invention relates to electronic fuzes for ordnance having a timing mechanism which can be preset to a selected time of flight to detonation.

2. Prior Art

Electronic fuzes for ordnance having a local oscillator which provides pulses to a counter which is preset to provide detonation upon reaching a predetermined count of pulses is now conventional and is shown in my patent U.S. Pat. No. 3,844,217 filed Sept. 28, 1972. Similar systems are shown by H. W. Euker et al in U.S. Pat. No. 3,067,684, filed July 27, 1960; L. R. Ambrosini in U.S. Pat. No. 3,500,746, filed Apr. 17, 1968; F. W. Flad in U.S. Pat. No. 3,646,371, filed July 25, 1969; Pitman et al in U.S. Pat. No. 3,718,092, filed Jan. 11, 1971; M. H. White et al in U.S. Pat. No. 3,750,583, filed Aug. 7, 1973; L. G. Stout in U.S. Pat. No. 3,793,957, filed Jan. 18, 1972, and in Technical Report 4624 "Beehive Electronic Time Fuze," dated April 1974, by Picatinny Arsenal, Dover, N.J. Various mechanisms for setting the counter are shown in Report 4624, supra, including setting rings driving odometer and tape type decimal to binary converters. In each of these converters each decimal order has required apparatus equal to each of the other orders. In a system utilizing a single tape to go from zero through three decimal orders in single digit increments, a significant amount of additional tape is required to progress through a fourth decimal order in the same single digital increments.

BRIEF SUMMARY OF THE INVENTION

It is an object of this invention to provide an additional order of decimal magnitude to a single, continuous-tape type, decimal to binary converter for a counter in a controlled range fuze, without utilizing the equivalent length of tape.

A feature of this invention is the provision of an additional order of decimal magnitude to a single, continuous-tape type, decimal to binary converter for a counter in a controlled range fuze, utilizing the setting ring for the tape to set in the additional order as a vernier to the tape supplied orders.

BRIEF DESCRIPTION OF THE DRAWING

These and other objects, advantages and features of the invention will be apparent from the following specification thereof taken in conjunction with the accompanying drawing in which.

DESCRIPTION OF THE PREFERRED EMBODIMENT

This invention may be incorporated in an electronic fuze having a setting ring and a single, continuous tape type decimal to binary converter as shown in my concurrently filed applications, Ser. No. 769,760, filed Feb. 17, 1977, and Ser. No. 769,757, filed Feb. 17, 1977.

Figure 1:
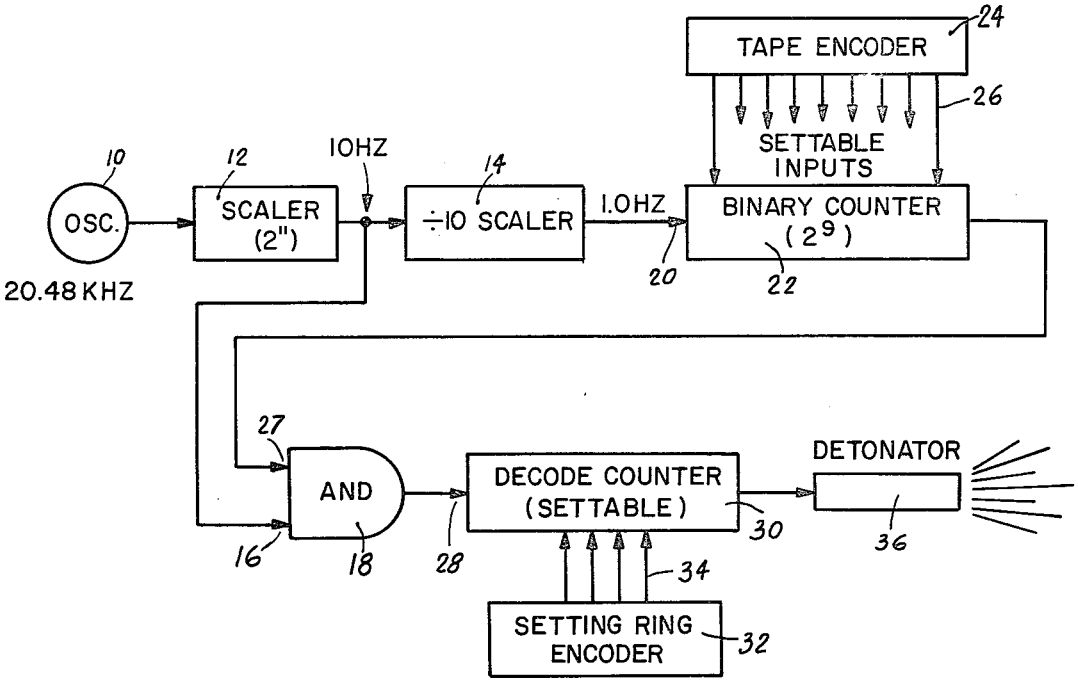
FIG. 1 is a schematic of an electronic fuze for ordnance embodying this invention.

As seen in FIG. 1, an exemplary fuze may comprise a local oscillator 10 providing pulses at a rate of 20.48 KHz to a first scaler 12 which passes one pulse of every $2^{11}$ received at the rate of 10 Hz to a second scaler 14 and to one input 16 of an AND gate 18. The second scaler 14 provides pulses at the rate of one pulse for every 10 pulses received at the rate of 1.0 to Hz to the input 20 of a binary counter 22 having nine stages. A single, continuous tape type decimal to binary converter or encoder 24 has nine inputs 26 for setting or not setting each stage of the binary counter to preset the counter to a predetermined count. Upon counting pulses to the predetermined count, the counter 22 provides a pulse to the second input 27 of the AND gate. When the AND gate is enabled by the concurrent presence of a pulse on both of its inputs, up to ten pulses from the scaler 12 are passed by the AND gate to the input 28 of a decade counter 30 which is formed as a binary counter having four stages. A decimal to binary converter or encoder 32 has four inputs for setting or not setting each stage of the decade counter to a predetermined count from zero to nine. Thus each possible preset count of the binary counter 22 is subdivided into ten parts. When the decade counter counts pulses to its predetermined count (after the binary counter has counted pulses to its predetermined count,) it provides an output signal to a detonator assembly 36 to detonate the fuze.

Figure 2:
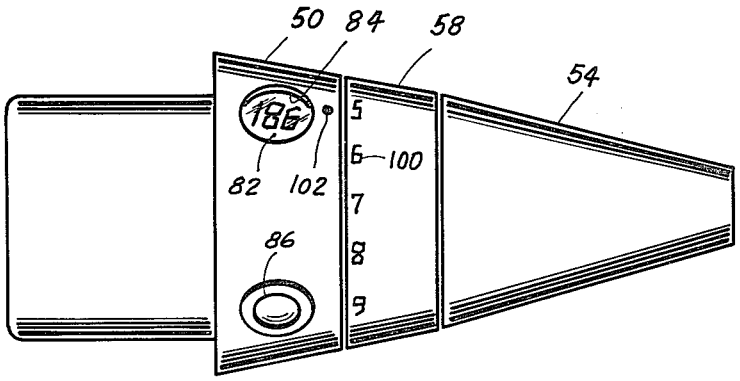
FIG. 2 is a side view of the fuze of FIG. 1.
Figure 3:
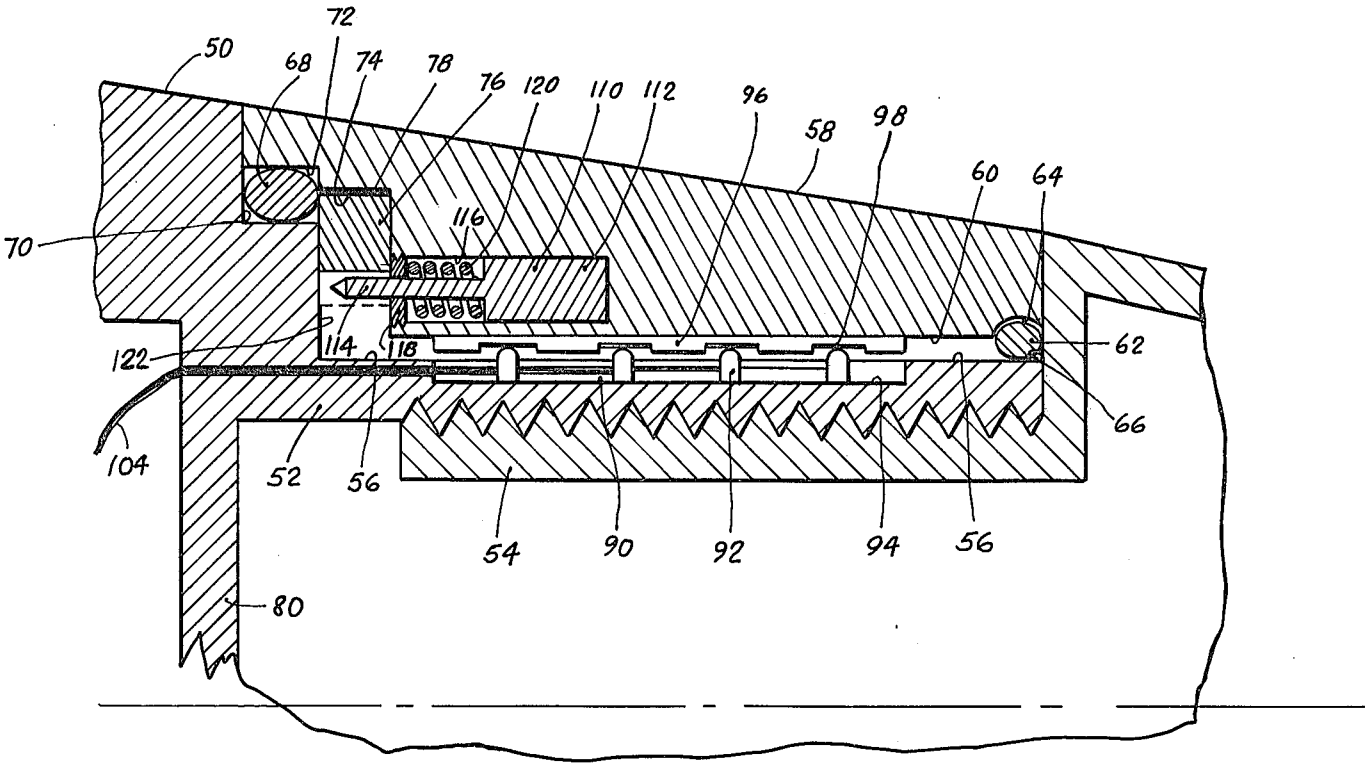
FIG. 3 is a detail longitudinal cross-section of the fuze of FIG. 1.

As seen in FIGS. 2 and 3, the exemplary fuze comprises a main body 50 which has a neck portion 52 into which is threaded a nose body 54. The neck portion has an outer cylindrical surface 56. A setting ring 58 is journaled for rotation on the surface 56 and has an inner cylindrical surfce 60. A forward O-ring seal 62 is provided between a shoulder 64 on the setting ring, a transverse face 66 on the nose body, and the surfce 56. On aft O-ring seal 68 is provided between a shoulder 70 on the main body and a shoulder 72 on the setting ring. An annular shoulder 74 is provided in the setting ring 58 in which is disposed an internally toothed ring gear 76. A layer of heavy grease 78 is disposed in the interface between the gear 76 and the setting ring and serves as a slip clutch therebetween. The ring gear 76 is meshed with an intermediate gear (not shown) which is journaled for rotation on a transverse plate portion 80 of the main body. Two spools are also journaled on the plate portion and have respective gears directly in mesh with the intermediate gear (all not shown). This rotation of the setting ring directly drives the two spools in opposite directions. A tape 82 is wound to and between the spools over a readout assembly. The tape has one surface carrying a column of rows of three decimal digits, each row indicating a number which is larger than the preceding number by one digit. This surface of the tape is visible, one row of digits at a time, through a transparent window 84 in the body. A detent is provided, operated by a spring loaded button 86, which normally engages between two teeth of the internal gear 76 to preclude movement of the internal gear, and thereby the tape 82 except when the button 86 is depressed. The othersurface of the tape has a second column of a plurality of circuit making combinational code means in correlation with said column of numbers, serving as a commutator for the readout assembly.

A contact assembly 90 of four pairs of spring loaded contacts 92 in a longitudinally extending row is fixed in a longitudinally extending slot 94 in the neck portion of the main body. A hollow cylinder 96 of dielectric material is fixed within and to the inner cylindrical surface of the setting ring. An annular column of ten rows of four areas 98 of conductive or dielectric characteristic in coded combinational array are provided on the inner face of the cylinder as a commutator in alignment with the four pairs of contacts. An annular column of decimal digits 100 is provided on the outer face of the setting ring in correlation with the column of areas 98. The slip clutch provided by the heavy grease 78 permits the setting ring to be rotated, while the ring gear 76 and the tape 82 are immobilized, to index (at 102 a selected digit, which aligns a corresponding row of areas with the row of contacts. Aligned conductive areas shunt their respective contacts, which via respective conductors 104 set the respective stages of the counter. Thus, in the exemplary fuze, the tape provides the coarse time setting of 0 to 200 seconds in one second increments and the setting ring provides the fine time setting of 0 to 0.9 seconds in 0.1 second increments. Thus, a tape setting of 186 and a setting ring position of 5 would result in a fuze setting of 186.5 seconds to detonation.

A setback locking pin 110 having a main body portion 112 and a stylus portion 114 is disposed in a longitudinally extending bore 116 in the setting ring. The bore is closed by a threaded in bushing 118 and the pin is biased forwardly by a helical compression spring 120, in which disposition the stylus clears the transverse surface 122 of the main body. Upon setback of the projectile, the inertia of the pin overcomes the bias of the spring and drives the stylus into the face 122 of the main body, precluding further rotation of the setting ring with respect to the main body.

What is claimed is:

1. An electronic, digital ordnance fuze comprising:

a first counter having an input means and having an output means for providing a first signal upon counting to a full count;

first means for presetting said fist counter to a selected first count;

a second counter having an input means and having an output means for providing a second signal upon counting to a full count;

second means for presetting said second counter to a selected second count;

means for providing pulses at a first rate to said input means of said first counter, and for providing pulses, at a second rate which is equal to product of multiplication of said first rate by the full count of said second counter, upon said first counter providing said first signal.

2. A fuze according to claim 1 wherein:

said first presetting means is adapted to set said first counter to any one plural decimal order number of a plurality of plural decimal order numbers; and said second presetting means is adapted to set said second counter to any one decimal digit in a single decimal order, said single decimal order being one decimal order lower than the lowest decimal order of said plural decimal order numbers.

3. A fuze according to claim 1 wherein:

said first presetting means includes a first commutator means having a first column of a plurality of uniformly increasing plural decimal order numbers, and a second column of a plurality of circuit making combinational code means in correlation with said first column; and said second presetting means includes a second commutator means having a third column of a plurality of uniformly increasing single order decimal digits, and a fourth column of a plurality of circuit making combinational code means in correlation with said first column.

4. A fuze according to claim 3 wherein:

said first commutator means includes a tape having one side bearing said first column of numbers and the other side bearing said second column of code means; and said second commutator means includes a settin ring having one surface bearing said third column of digits and a second surface bearing said fourth column of code means.

5. A fuze according to claim 4 further including:

first readout means for said code means of said tape;

drive means having a slip clutch and intercoupling said setting ring and said tape whereby rotation of said setting ring serves to advance said tape and said second column of said code means of said tape past said first read out means;

first releasable lock means for locking said drive means intermediate said slip clutch and said tape for precluding advancement of said tape;

second readout means for said code means of said setting ring:

said setting ring having a mode of operation such that rotation of said setting ring also nerves to advance said fourth column of code means past said second read out means;

said slip clutch having a mode of operation such that rotational force applied to said setting ring while said first lock means precludes advancement of said tape causes said slip cluth to slip and to permit said setting ring to rotate.

6. A fuze according to claim 5 further including:

second, normally released, lock means for locking said setting ring against rotation, having a mode of operation such that the application of set-back force to said fuze locks said second lock means.

7. An ordnance fuze comprising:

a setting ring;

commutator means;

drive means having a slip clutch and intercoupling said setting ring and said commutator means whereby rotation of said setting ring serves to correspondingly displace said commutator means;

first releasable lock means for locking said drive means intermediate said slip clutch and said commutator means for precluding displacement of said commutator means;

said slip clutch having a mode of operation such that rotational force applied to said setting ring, while said first lock means precludes advancement of said commutator means, causes said slip clutch to slip and to permit said setting ring to rotate.

8. A fuze according to claim 7 further including:

second, normally released, lock means for locking said setting ring against rotation, having a mode of operation such that the application of set-back force to said fuze locks said second lock means.

* * * * *

UNITED STATES PATENT AND TRADEMARK OFFICE

CERTIFICATE OF CORRECTION

PATENT NO. : 4,147,109

DATED : April 3, 1979

INVENTOR(S) : Richard Thomas Ziemba

It is certified that error appears in the above-identified patent and that said Letters Patent are hereby corrected as shown below:

Column 2, line 58 change "othersurface" to --other surface--.

Column 3, line 35 change "fist" to --first--.

Column 4, line 13 change "settin" to --setting--,
line 30 change "nerves" to --serves--,
line 36 change "cluth" to --clutch--.

Signed and Sealed this

*Eighteenth* Day of *November 1980*

[SEAL]

*Attest:*

SIDNEY A. DIAMOND

*Attesting Officer*

*Commissioner of Patents and Trademarks*